United States Patent [19]

Ueda et al.

[11] Patent Number: 4,883,544

[45] Date of Patent: Nov. 28, 1989

[54] PROCESS FOR PREPARATION OF AUSTENITIC STAINLESS STEEL HAVING EXCELLENT SEAWATER RESISTANCE

[75] Inventors: Masanori Ueda; Masayuki Abe, both of Kitakyushu; Kensai Shitani, Hikari; Tetsuo Yoshimoto; Hiroki Yamamoto, both of Kitakyushu; Fumio Kurosawa, Kawasaki, all of Japan

[73] Assignee: Nippon Steel Corporation, Tokyo, Japan

[21] Appl. No.: 282,110

[22] Filed: Dec. 9, 1988

[30] Foreign Application Priority Data

Dec. 12, 1987 [JP] Japan ..... 62-314834

[51] Int. Cl.[4] ..... B22D 25/06

[52] U.S. Cl. ..... 148/2; 148/12 E; 164/476; 164/477

[58] Field of Search ..... 148/2, 12 E; 164/459, 164/476, 477

[56] References Cited

U.S. PATENT DOCUMENTS

| | | | |
|---|---|---|---|
| 4,043,838 | 8/1977 | Deverell | 148/2 |
| 4,494,998 | 1/1985 | Ueda et al. | 148/2 |

FOREIGN PATENT DOCUMENTS

| | | | |
|---|---|---|---|
| 0058837 | 9/1982 | European Pat. Off. . | |
| 0083191 | 7/1983 | European Pat. Off. . | |
| 0235340 | 9/1987 | European Pat. Off. . | |
| 5716153A | 7/1980 | Japan . | |
| 56-29623 | 3/1981 | Japan | 148/12 E |
| 60-149748 | 1/1984 | Japan . | |
| 61-163247 | 1/1985 | Japan . | |
| 61-272322 | 12/1986 | Japan | 148/2 |

OTHER PUBLICATIONS

Patent Abstracts of Japan, vol. 12, No. 83 (M-677)[2930], 16th Mar. 1988; Japan-A-62 224 462 (Nippon Kokan K.K.) 2-10-87.

Patent Abstracts of Japan, vol. 6, No. 242 (M-175)[1120], 30th Nov. 1982; Japan-A-57 139 455 (Kawasaki Seitetsu K.K.), 8-28-82.

Continuous Casting, vol. 2, 1984, pp. 169-193, I.S.S. of AIME, Warrendale, US.; J. E. Lait et al., "Solidification During Continuous Casting of Steel."

Hot Workability of Austenitic Stainless Steels Containing Delta Ferrite, Authors: Tatsuo Kawasaki; Isao Takada; Hiroshi Ohtsubo and Shigeharu Suzuki.

Manufacturing Process and Properties of Stainless Steels Developed by Kawasaki Steel, Authors: Yutaka Ono and Hiroyuki Kaito.

*Primary Examiner*—Deborah Yee

*Attorney, Agent, or Firm*—Cushman, Darby & Cushman

[57] ABSTRACT

In a continuously cast piece of austenitic stainless steel having a large amount of Mo, segregation of alloy elements such as Mo and Cr is caused at the center part in the thickness direction of the slab, and the $\sigma$-phase is precipitated during the step of cooling the cast piece. When a heavy plate or hot coil is prepared from this cast piece as the starting material, cracking occurs in the hot-working step and the corrosion resistance of the final product is degraded. According to the present invention, at the cast piece-forming step, the super-heating degree of the molten steel is controlled to at least 25° C., whereby the equiaxed zone ratio is controlled to below 25%. When the heating times at the soaking and hot rolling treatments and the conditions for annealing the obtained steel sheet are controlled, the pitting resistance of the steel plate is greatly improved and cracking is prevented at the hot-working step.

17 Claims, 6 Drawing Sheets

RELATION BETWEEN EQUIAXED ZONE RATIO IN CC SLAB AND MINIMUM Mo CONTENT

RELATION BETWEEN SOAKING TIME AND MINIMUM Mo CONTENT

● EQUIAXED ZONE RATIO: 13 %

▲ EQUIAXED ZONE RATIO: 40 %

PROCESS FOR PREPARATION OF AUSTENITIC STAINLESS STEEL HAVING EXCELLENT SEAWATER RESISTANCE

BACKGROUND OF THE INVENTION

1. Field of the Invention

The present invention relates to a process for the preparation of austenitic stainless steel having an excellent corrosion resistance, especially seawater resistance. Furthermore, the present invention provides a steel material having an excellent workability such that edge cracking or face cracking does not occur when the material is hot-worked into a heavy plate, or a strip, or the like.

2. Description of the Related Art

The importance of stainless steel having a high corrosion resistance, especially a high resistance to corrosion from seawater, as the material for a plant for the desalination of seawater or the like will increase.

Most alloys suitable for use in this field contain Cr, Ni, Mo, Si and the like, and N is utilized as the element for improving the strength and corrosion resistance of stainless steel. As one such stainless steel material, the present inventors previously proposed a high-alloy stainless steel having not only a high corrosion resistance but also an excellent hot-workability, in Japanese Patent Application No. 60-4118 (Japanese Unexamined Patent Publication No. 61-163247).

Recently, a process is often adopted in which the step of forming a slab, as a material to be worked into a heavy plate or strip, from a high-alloy steel containing large quantities of elements as mentioned above, i.e., the step of forming a slab from a melt, is carried out by continuous casting. When a steel containing large quantities of Cr, Ni, Mo, and Si, is formed into a slab by continuous casting and the slab is hot-worked into a heavy plate or strip, an excellent workability is an important characteristic required for the production. At present, same technical problems must be solved, inclusive of this problem of the workability, in the production of high-alloy stainless steel materials by continuous casting.

As is well-known, Cr, Mo and N are especially important alloy components in stainless steel having a high resistance to corrosion from seawater, and it is particularly important that stainless steel having a high resistance to corrosion from seawater should contain 3 to 13% by weight of Mo.

Nevertheless, when a slab is formed by a continuous casting of 20% Cr-18% Ni type high-alloy steel containing 3 to 13% by weight of Mo, segregation having low contents of Mo and Cr is caused at the center in the thickness direction of the formed cast piece (slab), and it is impossible to obtain the aimed corrosion resistance in a final product because of this segregation.

Furthermore, the $\sigma$-phase is precipitated at the cast piece-cooling step of the continuous casting process, and this $\sigma$-phase is the factor that causes edge cracking or face cracking when the material is hot-worked.

As a means of improving the hot-workability by controlling the precipitation of the $\sigma$-phase in the above-mentioned high-alloy cast piece or moderating the segregation of the alloy elements, the present inventors previously proposed a process in which a soaking (homogenizing treatment) of the cast piece is the main step (Japanese Patent Application No. 62-201028), but use of this technical means alone did not provide a sufficient resistance to corrosion from seawater.

A technical object of the present invention is to solve the problem of the impossibility of obtaining a good resistance to corrosion from seawater because of a segregation having low contents of alloy elements such as Mo and Cr at the center in the thickness direction of the slab, which occurs when preparing a slab by a continuous casting of the above-mentioned high-alloy steel. Another object of the present invention is to improve the hot-workability by eliminating the precipitation of the $\sigma$-phase and to improve the corrosion resistance by diffusing Mo or Cr contained at a high content in the $\sigma$-phase and eliminating Mo- or Cr-poor regions.

SUMMARY OF THE INVENTION

The present invention provides a process in which a stainless steel heavy plate or strip has an excellent corrosion resistance, especially a resistance to corrosion from seawater, and the hot-workability is improved by using, as the starting material, a slab obtained by a continuous casting of an austenitic stainless steel containing a large quantity of Mo.

Furthermore, the present invention provides a stainless steel heavy plate or strip having an excellent corrosion resistance and hot-workability by improving the casting process and the soaking (homogenizing treatment) treatment of a cast piece (slab) or an intermediate material.

More specifically, in accordance with the present invention, in the continuous casting of a melt of an austenitic stainless steel containing 3 to 13% by weight of Mo, the occurrence of an inverse segregation of Mo and the like is moderated by controlling the difference (superheat temperature) between the temperature of the molten steel in a tundish and the melting point of the alloy, to at least 25° C., and further controlling the proportion of the equiaxed zone ratio in the section of the obtained cast piece to less than 25%, whereby an austenitic stainless steel heavy plate or strip having a high pitting resistance (the pitting resistance is a criterion of the resistance to corrosion from seawater) is obtained. Furthermore, by soaking this cast piece or intermediate material under conditions satisfying a specific relationship between the temperature and time, the $\sigma$-phase is extinguished and Mo, Cr and the like are diffused, whereby the hot-workability of the material is improved and the pitting resistance of the final product is further increased.

DESCRIPTION OF THE PREFERRED EMBODIMENTS

Figure 1:
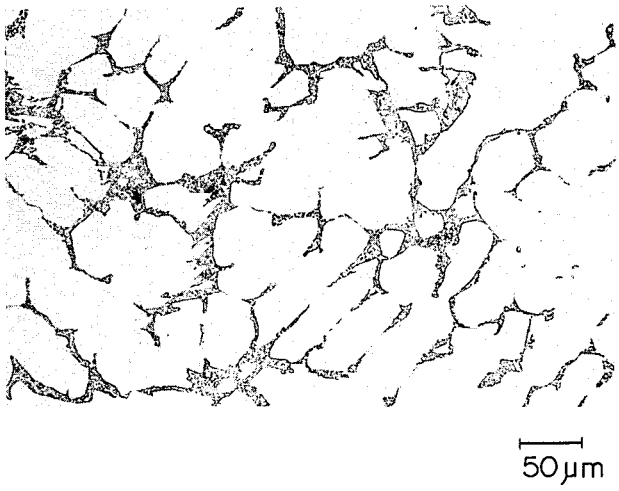
FIG. 1(A) is a microscope photograph showing a solidified structure of a cast piece obtained by continuously casting an alloy having a basic composition of 20% Cr-18% Ni-6.2% Mo-0.2% N.
FIG. 1(B) is a microscope photograph showing the microstructure obtained by soaking of 1250° C for 5 hours the cast piece, formed by a continuous casting of the same alloy as mentioned above with respect to FIG. 1(A) according to the process of the present invention. From FIG. 1(B), it is seen that little precipitates are present in the microstructure after the soaking treatment.
Figure 1:
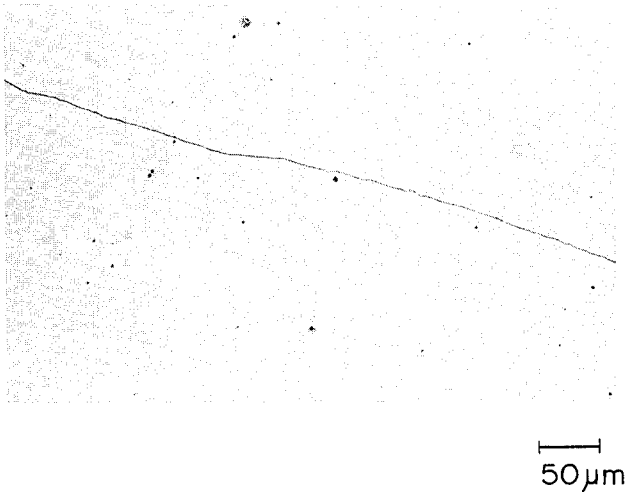

The process for preparing an austenitic stainless steel having an excellent seawater resistance according to the present invention will now be described in detail.

The present inventors carried out an in-depth study of a stabilization of the pitting resistance (which is a criterion of the resistance to corrosion from seawater) of alloys having a basic composition of 20% Cr-18% Ni-6.0% Mo and containing a large quantity of Mo. The compositions of steels (sample steels) used during the study are shown in Table 1.

cast piece having a low equiaxed zone ratio is subjected to a soaking treatment at the stage of the cast piece or at the stage of an intermediate material after preliminary rolling, the σ-phase formed at the cast piece-cooling step in the casting process is extinguished and Cr, Mo and the like are diffused to eliminate the unevenness in the concentrations of the alloy components, whereby the C.P.T. (critical pitting temperature) can be elevated to 75° C. or higher.

For an evaluation of the characteristics of the products, a method was adopted in which, with respect to steel plates (heavy plates and strips) obtained by subjecting slabs to preliminary rolling, finish rolling and annealing, the pitting temperature was determined and the pitting resistance was evaluated based on the C.P.T. (critical pitting temperature) measured at the pitting test in a 6% solution of $FeCl_3$ according to the ASTM standard.

Moreover, a study was made of the factors participating in the equiaxed zone ratio in the solidified structure of the cast piece, and as a result, it was found that the equiaxed zone ratio is greatly influenced by the difference [superheat temperature: ΔT (°C.)]between the temperature of the melt in a tundish in the casting process and the melting point of the alloy, or by whether or not electromagnetic stirring is applied or subjected. More specifically, with respect to continuously cast pieces having a thickness of 140 to 250 mm, the superheat temperature ΔT (°C.), the influence of electromagnetic stirring and the equiaxed zone ratio in the cast piece were examined. Furthermore, a search was made for conditions for extinguishing the σ-phase by soaking (homogenizing treatment) a cast piece or intermediate material and diffusing Cr, Mo and the like.

TABLE 1

| | Composition (% by weight) | | | | | | | | | | | | | | | |
|---|---|---|---|---|---|---|---|---|---|---|---|---|---|---|---|---|
| Sample Steel | C | Si | Mn | P | S | Cr | Ni | Mo | Cu | Al | O | N | Others | ΔT (°C.) | Electro-magnetic Stirring | Thickness (mm) of Slab |
| A | 0.010 | 0.55 | 0.58 | 0.020 | 0.0005 | 20.12 | 18.07 | 6.12 | 0.75 | 0.024 | 0.0066 | 0.215 | Ca 0.0036 | 44 | not applied or not subjected | 160 |
| B | 0.012 | 0.58 | 0.46 | 0.018 | 0.0007 | 19.94 | 17.74 | 6.17 | 0.62 | 0.027 | 0.0037 | 0.202 | Ca 0.0030 | 26 | applied or subjected | 190 |
| C | 0.015 | 0.53 | 0.51 | 0.021 | 0.0003 | 20.34 | 18.10 | 6.18 | 0.68 | 0.031 | 0.0042 | 0.203 | W 0.08 | 30 | not applied or not subjected | 140 |
| D | 0.011 | 0.46 | 0.44 | 0.020 | 0.0007 | 20.05 | 19.03 | 6.25 | 0.67 | 0.022 | 0.0039 | 0.189 | | 32 | applied or subjected | 140 |
| E | 0.017 | 0.48 | 0.52 | 0.020 | 0.0010 | 20.02 | 18.73 | 6.14 | 0.77 | 0.025 | 0.0038 | 0.209 | | 25 | applied or subjected | 250 |
| F | 0.011 | 0.50 | 0.51 | 0.019 | 0.0006 | 20.02 | 18.62 | 6.19 | 0.70 | 0.024 | 0.0023 | 0.196 | Nb 0.081 | 40 | not applied or not subjected | 190 |
| G | 0.018 | 0.44 | 1.33 | 0.021 | 0.0009 | 19.89 | 25.16 | 9.11 | | 0.031 | 0.0045 | 0.208 | | 20 | applied or subjected | 140 |
| H | 0.020 | 0.65 | 0.87 | 0.018 | 0.0021 | 27.60 | 35.22 | 6.37 | 2.80 | 0.022 | 0.0033 | 0.047 | Ti 0.061 | 38 | not applied or not subjected | 160 |
| I | 0.009 | 0.22 | 0.51 | 0.025 | 0.0011 | 27.63 | 31.47 | 4.72 | 0.86 | 0.041 | 0.0022 | 0.212 | V 0.07 | 32 | not applied or not subjected | 190 |
| J | 0.012 | 0.44 | 0.54 | 0.019 | 0.0003 | 22.38 | 23.41 | 4.15 | 1.20 | 0.037 | 0.0020 | 0.0022 | | 15 | applied or subjected | 140 |
| K | 0.011 | 0.48 | 0.61 | 0.020 | 0.0011 | 22.09 | 23.61 | 4.56 | 1.15 | 0.042 | 0.0015 | 0.027 | Ce 0.012 | 25 | applied or subjected | 140 |

As a result, it was found that, in high-alloy steels containing Mo in a large amount such as 6.0% by weight, the factor having a greatest influence on the pitting resistance is the equiaxed zone ratio in the cast structure.

Figure 3:
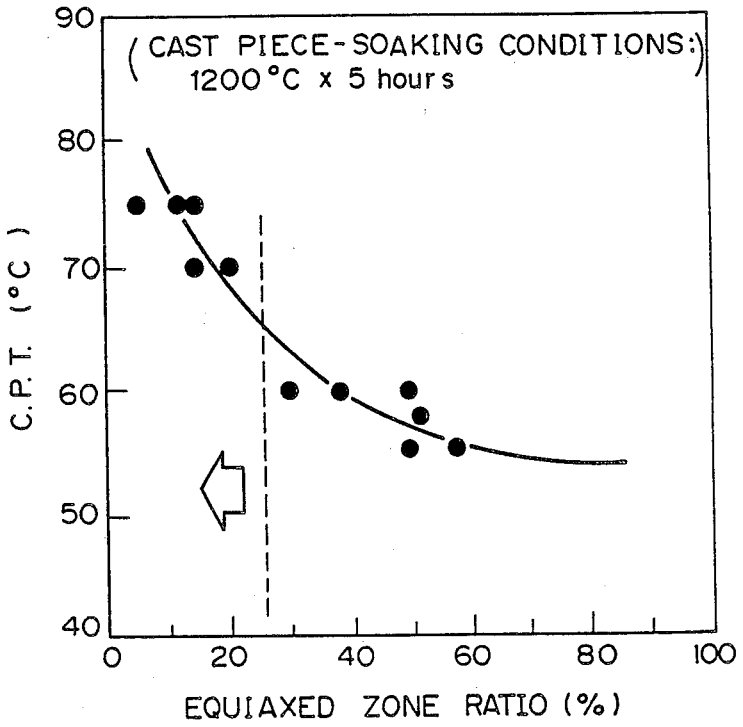
FIG. 3 is a diagram illustrating the relationship between the equiaxed zone ratio (%) in the cast structure and the critical pitting temperature (°C.) of a heavy plate product.

More specifically, it was found that, as shown in FIG. 3, the lower the equiaxed zone ratio in a cast piece (slab) obtained by casting, the higher the pitting corrosion occurring temperature (the higher the pitting resistance) in a final product (a heavy plate or a strip). If a It was found that large quantities of precipitates are present in continuously cast pieces of alloys having a basic composition of 20% Cr-18% Ni-6.2% Mo-0.2% N, as shown in FIG. 1(A). The composition of these precipitates is shown in Table 2, and when these precipitates were examined by the X-ray diffractometry, it was found that these precipitates form a σ-phase. As apparent from Table 2, Mo and Cr are very rich in the σ-phase and Mo- or Cr-poor regions are present around the σ-phase. It was found that these σ-phase and Mo- or Cr-poor regions remain in the final product and degrade the pitting resistance. Accordingly, a search was made for casting conditions for reducing or extinguishing this σ-phase.

TABLE 2

| Chemical Composition of Precipitates (atom %) | | | | | |
|---|---|---|---|---|---|
| Fe | Cr | Mo | Ni | Mn | Cu |
| 44.9 | 31.5 | 10.6 | 12.0 | 0.62 | 0.10 |

As a result, it was found that the solidified structure of the cast piece has a great influence on the segregation of Mo, Cr and the like, and on the σ-phase. More specifically, alloy elements are concentrated among dentrites while a solidification of the melt is advanced in the casting process, but if large quantities of equiaxed grains are present, sites having a space are formed. It is considered that, when the solidification is further advanced, the concentrated residual melt migrates selectively in spaces formed among equiaxed grains and are thus solidified, and as a result, parts in which the residual melt is accumulated are formed in the solidified structure, and precipitation of the σ-phase is caused at these parts where the alloy elements are concentrated. Simultaneously, segregation having low alloy element concentrations occurs around these parts under the influence of the flow of the molten steel and the migration of the concentrated molten steel, and as a result, in the cast piece, many parts are formed wherein the concentrations of the alloy elements are very different, i.e., the segregation is large.

Figure 5:
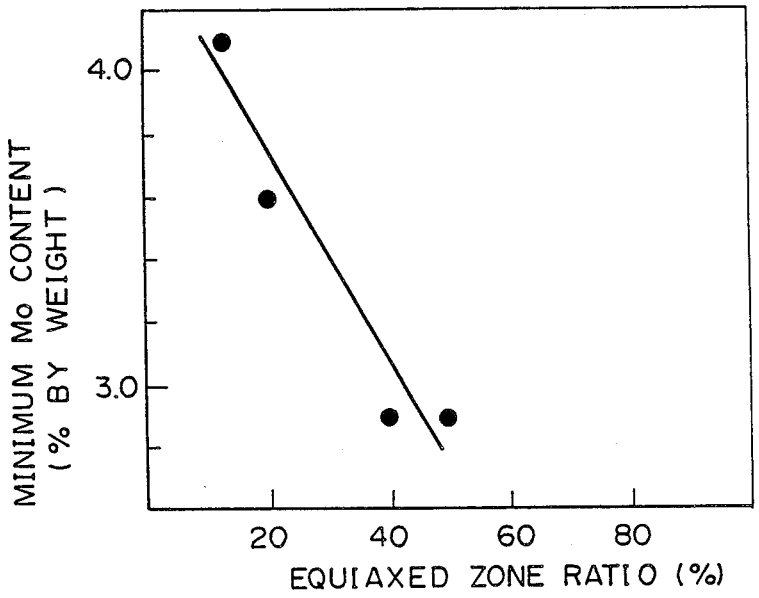
FIG. 5 is a diagram illustrating the relationship between the equiaxed zone ratio (%) and the minimum Mo content (% by weight) in a continuously cast slab containing 6% by weight of Mo on average.
Figure 6:
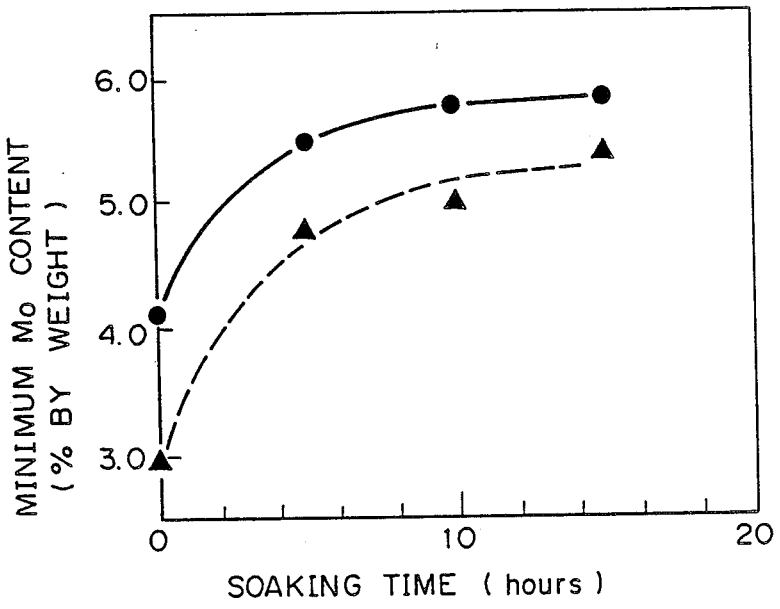
FIG. 6 is a diagram illustrating the relationship between the time of soaking a cast piece or intermediate material containing 6% by weight of Mo on average and the minimum Mo content (% by weight) with respect to various levels of the equiaxed zone ratio (%).

FIG. 3 illustrates the results of a determination of the pitting corrosion occurring temperature in a heavy plate obtained by subjecting a cast piece as mentioned above to a soaking treatment at 1200° C. for 5 hours and a rolling operation. As apparent from FIG. 3, an increase of the equiaxed zone ratio results in a degradation of the pitting resistance. FIG. 5 illustrates the relationship between the equiaxed zone ratio in the cast piece and the minimum Mo content. From FIG. 5, it is seen that, if the equiaxed zone ratio is increased, a part is formed wherein Mo segregates very thinly, and this segregation causes a degradation of the pitting resistance. When a cast piece having parts in which alloy elements segregate extremely thinly is used as the starting material, if this cast piece is subjected to a soaking treatment at the stage of this test piece or an intermediate material, the alloy element concentrations cannot be restored to levels sufficient to realize a satisfactory corrosion resistance, as shown in FIG. 6, because the restoration is restricted by the cast structure in the starting material.

From the results of the foregoing studies, it was concluded that, to increase the pitting resistance, it is very important to reduce the equiaxed zone ratio in the cast piece.

More specifically, if the equiaxed zone ratio in the cast piece is reduced below 25%, by soaking the test piece or intermediate material as described hereinafter, the critical pitting temperature (C.P.T.) can be elevated to a level of 65° C. or higher. Especially, if the equiaxed zone ratio is below 10%, the critical pitting temperature (C.P.T.) can be elevated to a level of 75° C. or higher. Namely, if the equiaxed zone ratio is reduced in the cast piece, the effect of soaking or rolling is conspicuous and the physical properties can be stably maintained at high levels.

Figure 2:
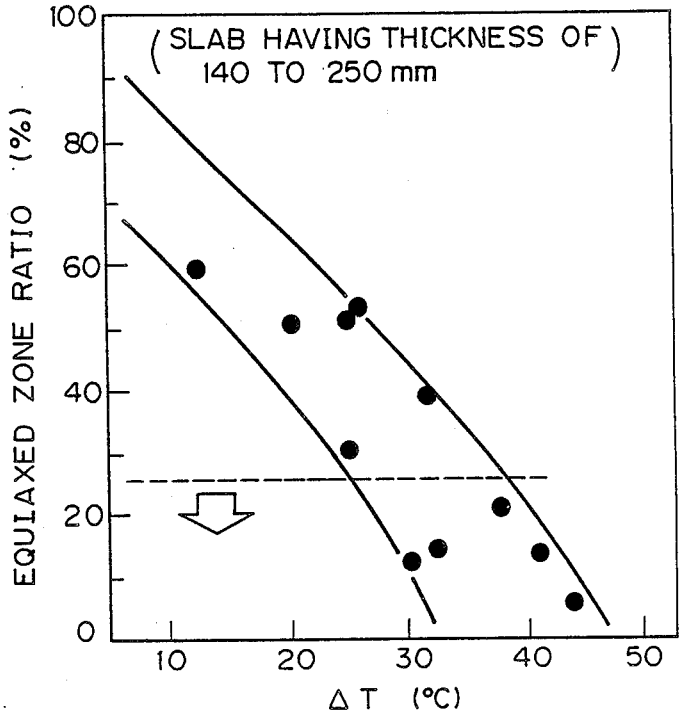
FIG. 2 is a diagram illustrating the relationship between the difference [superheat temperature: $\Delta T$ (°C.)]between the temperature of a melt in a tundish in the continuous casting of a high-alloy stainless steel and the melting point of this alloy to the equiaxed zone ratio (%) in the section of the obtained cast piece (in the case of a slab having a thickness of 140 to 250 mm)

As the means for reducing the equiaxed zone ratio in the cast piece, there can be effectively adopted a method in which the superheat temperature [ΔT(°C.)] of the melt in a tundish in the casting process is maintained within a predetermined range as described hereinbefore. FIG. 2 illustrates the relationship between the superheat temperature [ΔT(°C.)] and the equiaxed zone ratio in the cast piece. As is apparent from FIG. 2, to control the equiaxed zone ratio below 25%, the superheat temperature [ΔT(°C.)] of the melt must be at least 25° C.

As the means for controlling the superheat temperature [ΔT(°C.)] of the molten steel, there can be adopted not only a method in which the temperature of the molten steel to be poured into a tundish is maintained within a predetermined range, but also a method in which, to reduce the quantity of radiated heat of the molten steel to a level as low as possible, the quantity of the molten steel in the tundish is controlled by adjusting the quantity of the molten steel poured into the tundish or the speed of drawing out the cast piece. Furthermore, as the means for directly controlling the temperature of the melt, there can be adopted a method in which the molten steel is heated by induction heating or plasma heating and a method in which the molten steel is heated by using a heating nozzle.

Electromagnetic stirring of the cast piece in the casting process is not preferred, because the equiaxed zone region is broadened thereby.

FIG. 1(B) is a microscope photograph showing the microstructure obtained by soaking at 1250° C. for 5 hours the cast piece, formed by a continuous casting of the same alloy as mentioned above with respect to FIG. 1(A) according to the process of the present invention. From FIG. 1(B) it is seen that little precipitates are present in the microstructure after the soaking treatment.

Figure 4:
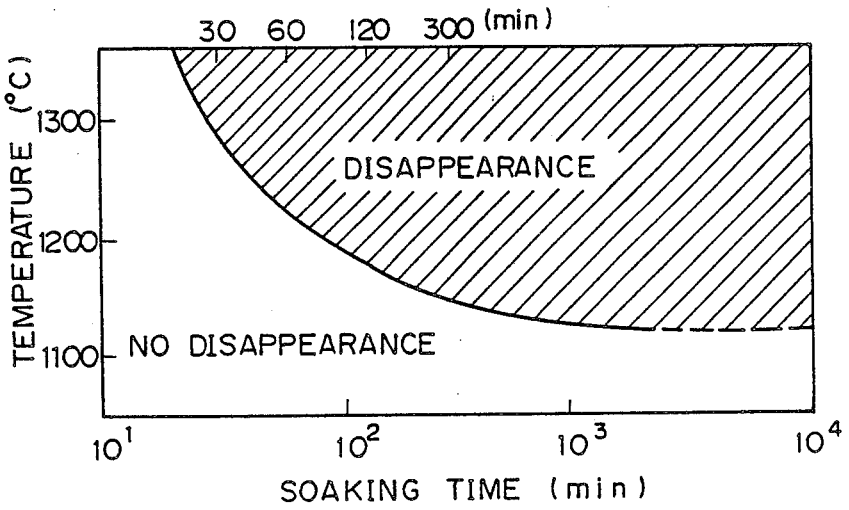
FIG. 4 is a diagram showing the relationship between the soaking temperature and the soaking time, which illustrates the decrease and disappearance of the σ-phase present in a continuously cast piece of an austenitic stainless steel having a composition of 20% Cr-18%Ni-6%Mo-0.2%N.

In the present invention, the soaking treatment of the cast piece is carried out as the heat treatment of the cast piece in a hatched region, shown in FIG. 4, of the temperature/time relationship before the hot rolling.

Note, the hot rolling mentioned above includes the rolling conducted for forming a heavy steel plate by rolling the cast piece and the rolling adopted for forming a heavy plate or hot strip by preliminary rolling and finish rolling of the cast piece.

It was confirmed that it is important that a slab formed by performing the soaking treatment in a hatched region, shown in FIG. 4, of the temperature-time relationship before or after preliminary rolling so that the sum of the heating time at this soaking treatment and the heating time before rolling of a heavy plate or hot strip is at least 2 hours, should be hot-rolled, the rolled slab should be cooled from a temperature higher than 700° C. at a cooling rate of at least 3° C./sec, and the formed steel sheet should be annealed at a temperature higher than 1100° C. and then cooled by water cooling.

More specifically, the soaking treatment of the cast piece must be carried out under the temperature and time conditions shown in FIG. 4. The soaking temperature and heat temperature for hot rolling must be higher than 1100° C. and the sum of the soaking time and the heating time for rolling must be at least 2 hours, although these conditions differ to some extent according to the casting conditions, and rolling at a thickness reduction ratio of 10 to 60%, conducted during the foregoing treatments, is especially effective. If these conditions are satisfied, the pitting resistance can be further improved.

If air cooling is carried out after the hot rolling, precipitation of the σ-phase often occurs. Therefore, preferably the accelerated cooling is carried out by water cooling or the like after the hot rolling.

At the solution treatment after the hot rolling, the σ-phase must be extinguished by conducting the heat treatment at a temperature higher than 1100° C. for a sufficient time. After the solution treatment, the accelerated cooling is carried out by water cooling. At the cooling step, preferably the water cooling-initiating temperature is at a level of at least 1000° C., and the water cooling is started at a temperature of at least 900° C. If a water cooling is started at a temperature lower than 900° C., the σ-phase is precipitated during cooling from the annealing temperature, and the pitting resistance is degraded.

The effects based on the above-mentioned idea can be attained broadly in alloy systems by which the hot-workability of continuously cast steel pieces is improved, i.e., alloys comprising 0.005 to 0.3% by weight of C, up to 5% by weight of Si, up to 8% by weight of Mn, up to 0.04% by weight of P, 15 to 35% by weight of Cr, 10 to 40% by weight of Ni, 3 to 13% by weight of Mo, up to 30 ppm of S, up to 70 ppm of O 0.001 to 0.1% by weight of Al, 0.01 to 0.5% by weight of N, and as optional components, 0.001 to 0.008% by weight of Ca, 0.005 to 0.05% by weight of Ce and at least one member selected from up to 3% by weight of Cu, up to 1% by weight of Nb, up to 1% by weight of V, up to 2% by weight of W, up to 0.5% by weight of Zr, up to 0.5% by weight of Ti and up to 0.1% by weight of Sn, with the balance being Fe and unavoidable impurities.

The reasons for limitation of the contents of the respective components will now be described.

C

C is detrimental to the corrosion resistance but is desirable from the viewpoint of the strength. If the C content is lower than 0.005% by weight, the manufacturing cost is increased, and if the C content exceeds 0.3% by weight, the corrosion resistance is drastically degraded. Accordingly, the C content is limited to 0.005 to 0.3% by weight.

Si

Si effectively improves the corrosion resistance of stainless steel and the oxidation resistance, but if the Si content exceeds 5% by weight, the hot-workability is degraded.

Mn

Mn can be added as a substitute for expensive Ni, and Mn increases the solid solubility of N but degrades the corrosion resistance. Accordingly, the upper limit of the Mn content is set at 8% by weight. If the Mn content exceeds 8% by weight, the corrosion resistance and oxidation resistance are degraded.

P

From the viewpoint of the corrosion resistance and hot-workability, a lower P content is preferred, and the P content is limited to 0.04% by weight. If the P content exceeds 0.04% by weight, the corrosion resistance and hot-workability are degraded.

S

S drastically degrades the hot-workability, and a lower S content is preferred. The S content, as well as the O content, must be controlled to as low a level as possible. Accordingly, the S content is limited to up to 0.003% by weight. Furthermore, from the viewpoint of the corrosion resistance, preferably the S content is low, and therefore, the S content is limited to up to 0.003% by weight.

O

O drastically degrades the hot-workability as well as S, and a lower O content is preferred. The O content, as well as the S content, must be controlled to a low level. Accordingly, the O content is limited to up to 0.007% by weight.

Cr

Cr is a basic component of stainless steel, and where a high corrosion resistance, for example, a high seawater resistance, is required, Cr should be added in an amount of at least 15% by weight even when Mo and Ni are simultaneously added, and as the Cr content is increased, the corrosion resistance and oxidation resistance are improved. Nevertheless, if the Cr content exceeds 35% by weight, the effect is saturated and the alloy becomes expensive.

Ni

Ni is a basic component of stainless steel as well as Cr, and where a high corrosion resistance, for example, a high seawater resistance, is required, Ni is added together with Cr and Mo. To stabilize the austenitic phase, Ni must be incorporated in an amount of 10% by weight, and as the Ni content is increased, the corrosion resistance and oxidation resistance are improved, but if the Ni content exceeds 40% by weight, the alloy becomes expensive.

N

N improves the strength and corrosion resistance of stainless steel, but if the N content is higher than 0.01% by weight, the N content exceeds the solid solubility and, below-holes are formed.

Mo

Mo improves the corrosion resistance, especially the seawater resistance, and the effect is prominent if the Mo content is 3 to 13% by weight. If the Mo content is lower than 3% by weight, the seawater resistance is insufficient, and if the Mo content exceeds 13% by weight, the effect is saturated and the alloy becomes expensive.

Al

Al is added as a strong deoxidizer in an amount of 0.001 to 0.1% by weight. If the Al content exceeds 0.1% by weight, the corrosion resistance and hot-workability are degraded.

Cu

Cu improves the corrosion resistance of stainless steel, and Cu is added in an amount of up to 3% by weight selectively according to the intended use. If the Cu content exceeds 3% by weight, the hot-workability is degraded.

Nb

Nb increases the strength of stainless steel as well as N and fixes C to improve the corrosion resistance. Nb is added in an amount of 1% by weight selectively according to the intended use. If the Nb content exceeds 1% by weight, the hot-workability is degraded.

Ti

Ti fixes C to improve the corrosion resistance and fixes O together with Ca to prevent a formation of an oxide of Si and Mn and greatly improve the hot-workability and corrosion resistance. Therefore, Ti is added in an amount of up to 0.5% by weight selectively according to the intended use. If the Ti content exceeds 0.5% by weight, the hot-workability is degraded.

Ca

Ca is selectively added as a strong deoxidizer or desulfurizer in an amount of 0.001 to 0.008% by weight. If the Ca content exceeds 0.008% by weight, the corrosion resistance is degrated.

Ce

Ce is selectively added as a strong deoxidizer or desulfurizer in an amount of 0.005 to 0.05% by weight. If the Ce content exceeds 0.05% by weight, the corrosion resistance is degraded.

V

V improves the corrosion resistance of stainless steel and is added in an amount of up to 1% by weight selectively according to the intended use. If the V content exceeds 1% by weight, the effect is saturated.

W

W improves the corrosion resistance of stainless steel and is added in an amount of up to 2% by weight according to the intended use. If the W content exceeds 2% by weight, the effect is saturated.

Sn

Sn improves the acid resistance of stainless steel and is added in an amount of up to 0.1% by weight selectively according to the intended use. If the Sn content exceeds 0.1% by weight, the effect is saturated.

Zr

Zr improves the corrosion resistance of stainless steel and is added in an amount of up to 0.5% by weight according to the intended use.

The present invention will now be described in detail with reference to the following examples, that by no means limit the scope of the invention.

EXAMPLE 1

A high-Mo stainless steel having a chemical composition shown in Table 3 was prepared by the electric furnace-AOD process, desulfurization and deoxidation were thoroughly carried out, and Al, Ti, Ca, Ce and the like were selectively added. The molten steel having an S content lower than 30 ppm and an O content lower than 70 ppm was cast into a continuously cast slab having a thickness of 140 to 250 mm. The casting conditions were controlled so that the superheat temperature [ΔT(°C.)] of the molten steel was at least 25° C. and the equiaxed zone ratio in the section of the slab was lower than 25%. The superheat temperature [ΔT(°C.)] and the equiaxed zone ratio are shown in Table 3. A comparative material was prepared by casting the above-mentioned composition at ΔT(°C.) of 15° C., and in this comparative material, the equiaxed zone ratio was 60%. These cast pieces were soaked at 1220 to 1270° C., and the substantial soaking time of the central part of the cast piece was adjusted to 5 hours. Then, the surface defect of the cast pieces were removed, and a part of the cast pieces was sent to the heavy plate mill and remaining part of the cast pieces was sent to the hot strip mill. At the above mills, the cast pieces were heated at a temperature higher than 1200° C. and rolled to a final thickness. The thickness was reduced to 6 to 35 mm by hot rolling at the heavy plate-forming step, and the thickness was reduced to 3 to 6.5 mm at the hot strip mill. In each case, after the hot rolling, water cooling was started at 700 to 900° C. or a higher temperature to prevent the precipitation of the $\sigma$-phase. At the annealing step, the heavy plates and strips were maintained at a temperature of 1120 to 1250° C. for 3 to 60 minutes, and water cooling was started at a high temperature such as a temperature exceeding 900° C. Test pieces for the corrosion test were collected from these products, and the pitting test was carried out in a 6% solution of $FeCl_3$ at various temperatures to examine the pitting corrosion occurring temperature.

As a result, in the final product produced by the cast piece, the cast structure of which was controlled to reduce the equiaxed zone content according to the process of the present invention, the pitting resistance was high and the critical pitting temperature (C.P.T.) was at least 70° C. On the other hand, in the final product produced by the cast piece in which the superheat temperature [ΔT(°C.)] was low and the equiaxed zone ratio was high,- the pitting resistance was low and the C.P.T. could not be maintained at a level of 65° C. or higher.

EXAMPLE 2

The same continuously cast piece as used in Example 1 was soaked at 1240° C. for 2 hours and rolled at a thickness reduction ratio of 30 to 45% by a hot rolling mill, and the rolled cast piece was soaked at 1240° C. for 2 hours. Then, the formed slab was post-treated and was not rolled at the heavy plate-forming step, in the same manner as described in Example 1, to obtain a heavy plate having a thickness of 20 mm. After the rolling, water cooling was started at a temperature higher than 700° C. Then, the solution treatment was thoroughly carried out, and the pitting resistance of the product was examined. According to the process of the present invention, the C.P.T. was maintained at a level of at least 70° C. but in the comparative material in which the superheat temperature [ΔT(°C.)] was low, the C.P.T. was lower than 65° C.

TABLE 3

Compositions of Sample Steel, Casting Conditions and Equiaxed Zone Ratios

| Steel No. | | Chemical Compostion (% by weight) | | | | | | | | | | | | | Casting Conditions | | |
|---|---|---|---|---|---|---|---|---|---|---|---|---|---|---|---|---|---|
| | | C | Si | Mn | P | S | Cu | Cr | Ni | Mo | Al | O | N | Others | Thickness (mm) of Casting Piece | Superheat Temperature ΔT(°C.) | Equiaxed Zone Ratio (%) |
| Process of Present Invention | 1 | 0.014 | 0.42 | 0.68 | 0.020 | 0.0008 | 0.75 | 24.02 | 23.20 | 6.10 | 0.025 | 0.0030 | 0.210 | Ti 0.05 | 140 | 35 | 16 |
| | 2 | 0.010 | 0.55 | 0.57 | 0.019 | 0.0005 | 0.77 | 20.13 | 17.90 | 6.20 | 0.026 | 0.0033 | 0.217 | Ca 0.0030 | 190 | 42 | 10 |
| | 3 | 0.045 | 0.22 | 0.46 | 0.020 | 0.0003 | | 22.84 | 30.01 | 4.00 | 0.024 | 0.0037 | | Ca 0.0038 | 250 | 48 | 8 |
| Compar- | 4 | 0.016 | 0.45 | 0.88 | 0.024 | 0.0010 | 0.65 | 20.16 | 19.01 | 6.21 | 0.026 | 0.0046 | 0.190 | Ca | 190 | 15 | 60 |

TABLE 3-continued

| Steel No. | Compositions of Sample Steel, Casting Conditions and Equiaxed Zone Ratios: Chemical Compostion (% by weight) C | Si | Mn | P | S | Cu | Cr | Ni | Mo | Al | O | N | Others | Casting Conditions: Thickness (mm) of Casting Piece | Super-heat Tempera-ture ΔT(°C.) | Equi-axed Zone Ratio (%) |
|---|---|---|---|---|---|---|---|---|---|---|---|---|---|---|---|---|
| ison | | | | | | | | | | | | | 0.0021 | | | |

As apparent from the foregoing description, according to the present invention, the cast structure of high-alloy stainless steel, which has problems in the conventional technique, is greatly improved and a stainless steel having a high corrosion resistance can be prepared. With respect to the corrosion resistance, degradation by inverse segregation of Mo and formation of precipitates of the σ-phase caused by an incorporation of alloy components at a high content can be prevented, and a satisfactory high seawater resistance can be maintained.

We claim:

1. A process for the preparation of an austenitic stainless steel having an excellent seawater resistance, which comprises pouring a melt of an austenitic stainless steel containing 3 to 13% by weight of Mo in a casting mold and forming a cast piece by continuous casting, wherein the temperature of the melt poured into the casting mold is controlled so that the temperature of the melt is higher by at least 25° C. than the melting point of the alloy, to form a cast piece in which the equiaxed zone ratio in the section of the cast piece is lower than 25%, and then heating treating, hot rolling and annealing the cast piece.

2. A process according to claim 1, wherein the soaking treatment is carried out as the heat treatment under temperature and time conditions included in a hatched region shown in FIG. 4.

3. A process according to claim 2, wherein the heat treatment comprises maintaining the cast piece under the soaking conditions for at least 2 hours and hot-rolling the soaked cast piece.

4. A process according to claim 2, wherein the heat treatment comprises maintaining the cast piece in a soaking zone of a heating furnace before preliminary rolling for at least 2 hours and subjecting the soaked cast piece to preliminary rolling and finish rolling.

5. A process according to claim 2, wherein the heat treatment comprises maintaining the cast piece in a soaking zone of a heating furnace before preliminary rolling and in a soaking furnace before preliminary rolling for a total time of at least 2 hours and subjecting the soaked cast piece to finish rolling.

6. A process according to claim 2, wherein the heat treatment comprises maintaining the cast piece in a soaking zone of a heating furnace before preliminary rolling and in a soaking furnace after preliminary rolling for a total time of at least 2 hours and subjecting the soaked cast piece to finish rolling.

7. A process according to claim 5, wherein the cast piece is maintained in a soaking furnace after preliminary rolling.

8. A process according to any of claim 1, wherein the cast piece is subjected to preliminary rolling at a thickness reduction ratio of 10 to 60%.

9. A process according to any of claim 4, wherein the cast piece is subjected to preliminary rolling at a thickness reduction ratio of 10 to 60%.

10. A process according to any of claim 5, wherein the cast piece is subjected to preliminary rolling at a thickness reduction ratio of 10 to 60%.

11. A process according to any of claim 6, wherein the cast piece is subjected to preliminary rolling at a thickness reduction ratio of 10 to 60%.

12. A process according to any of claim 7, wherein the cast piece is subjected to preliminary rolling at a thickness reduction ratio of 10 to 60%.

13. A process according to claim 1, wherein the hot-finish-rolled steel plate is subjected to annealing at a temperature higher than 1100° C. and then cooled by water cooling started at a temperature higher than 900° C.

14. A process according to claim 1, wherein a melt of an austenitic stainless steel comprising 0.005 to 0.3% by weight of C, up to 5% by weight of Si, up to 8% by weight of Mn, up to 0.04% by weight of P, 15 to 35% by weight of Cr, 10 to 40% by weight of Ni, 3 to 13% by weight of Mo, up to 30 ppm of S, up to 70 ppm of O, 0.001 to 0.1% by weight of Al, 0.01 to 0.5% by weight of N, and as optional components, 0.001 to 0.008% by weight of Ca, 0.005 to 0.05% by weight of Ce and at least one member selected from the group consisting of up to 3% by weight of Cu, up to 1% by weight of Nb, up to 1% by weight of V, up to 2% by weight of W, up to 0.5% by weight of Zr, up to 0.5% by weight of Ti and up to 0.1% by weight of Sn, with the balance being Fe and unavoidable impurities, is poured into the casting mold.

15. A process for the preparation of an austenitic stainless steel, which comprises pouring a melt of an austenitic stainless steel having a chemical composition as set forth in claim 14 into a casting mold and forming a cast piece by continuous casting, wherein the temperature of the melt is controlled so that the superheat temperature of the molten steel is at least 25° C. To maintain the equiaxed zone ratio in the section of the cast piece below 25%, the cast piece is maintained for at least 2 hours under temperature and time conditions included in a hatched region shown in FIG. 4, the hot rolling is then conducted to obtain a steel plate, the steel plate is annealed at a temperature higher than 1100° C., and the steel plate is cooled by water cooling started at a temperature higher than 900° C.

16. A process for the preparation of an austenitic stainless steel, which comprises pouring a melt of an austenitic stainless steel having a chemical composition as set forth in claim 14 into a casting mold and forming a cast piece by continuous casting, wherein the temperature of the melt is controlled so that the superheat temperature of the molten steel is at least 25° C. To maintain the ratio of an equiaxed zone ratio in the section of the cast piece below 25%, the cast piece is maintained for at least 2 hours before and/or after preliminary rolling under temperature and time conditions included in a hatched region shown in FIG. 4, the hot rolling is then conducted to obtain a steel plate, the steel plate is annealed at a temperature higher than 1100° C., and the steel plate is cooled by water cooling started at a temperature higher than 900° C.

17. A process according to claim 16, wherein the preliminary rolling is conducted at a thickness reduction ratio of 10 to 60%.

* * * * *